US008936306B2

(12) United States Patent
Liu et al.

(10) Patent No.: US 8,936,306 B2
(45) Date of Patent: Jan. 20, 2015

(54) COMPOSITE CHAIR

(71) Applicant: Keysheen Industry(Shanghai) Co., Ltd., Shanghai (CN)

(72) Inventors: Lausan Chung-Hsin Liu, Shanghai (CN); Shopo Hsin Tsu Liu, Shanghai (CN); Fibro Tsu Kun Liu, Shanghai (CN)

(73) Assignee: Keysheen Industry (Shanghai) Co., Ltd., Shanghai (CN)

( * ) Notice: Subject to any disclaimer, the term of this patent is extended or adjusted under 35 U.S.C. 154(b) by 0 days.

(21) Appl. No.: 13/895,935

(22) Filed: May 16, 2013

(65) Prior Publication Data

US 2014/0339860 A1 Nov. 20, 2014

(51) Int. Cl.
*A47B 39/00* (2006.01)
*A47B 83/02* (2006.01)

(52) U.S. Cl.
CPC ..... *A47B 83/02* (2013.01)
USPC ..... 297/144; 297/234; 297/233; 297/344.15

(58) Field of Classification Search
USPC ..... 297/236, 234, 237, 233, 232, 344.15, 297/144, 338
See application file for complete search history.

(56) References Cited

U.S. PATENT DOCUMENTS

| | | | | | |
|---|---|---|---|---|---|
| 1,063,809 | A * | 6/1913 | Lawson | 297/233 |
| 3,784,249 | A * | 1/1974 | Hendrickson et al. | 297/162 |
| 4,025,107 | A * | 5/1977 | Chippa | 297/17 |
| 4,249,774 | A * | 2/1981 | Andreasson | 297/311 |
| 4,461,444 | A * | 7/1984 | Grassl et al. | 248/550 |
| 5,316,370 | A * | 5/1994 | Newman | 297/313 |
| 5,588,377 | A * | 12/1996 | Fahmian | 108/145 |
| 5,997,083 | A * | 12/1999 | Ono et al. | 297/237 |
| 6,644,737 | B2 * | 11/2003 | Kohl et al. | 297/217.1 |
| 7,021,713 | B2 * | 4/2006 | Kao et al. | 297/339 |
| 7,918,503 | B2 * | 4/2011 | Ahlqvist et al. | 297/234 |
| 8,360,524 | B2 * | 1/2013 | Deml et al. | 297/344.15 |
| 8,733,829 | B2 * | 5/2014 | Liu et al. | 297/119 |

* cited by examiner

*Primary Examiner* — Chi Q Nguyen
(74) *Attorney, Agent, or Firm* — Muncy, Geissler, Olds & Lowe, P.C.

(57) ABSTRACT

A composite chair includes a stationary seat and a movable portion installed on the stationary seat. The stationary seat includes at least one first carrying portion and two first tracks. The movable portion includes a second carrying portion and a linkage mechanism connected to the stationary seat and second carrying portion to allow the second carrying portion to proceed a lift movement against the stationary seat. The second carrying portion includes two second tracks. The linkage mechanism includes two first linkage bars and two second linkage bars. Through the first and second linkage bars sliding in the first and second tracks, the second carrying portion can be lifted and switched to become a tabletop or a seat.

6 Claims, 6 Drawing Sheets

COMPOSITE CHAIR

FIELD OF THE INVENTION

The present invention relates to a composite chair and particularly to a chair that provides tabletop and seating functions.

BACKGROUND OF THE INVENTION

Chairs generally aim for people seating or resting. In order to make limited living space be utilized more efficient in modern houses, many furniture producers have tried to improve conventional single-function furniture to become multifunctional to serve multiple purposes. Hence composite furniture is developed. It has features of simple assembly and transformation to provide multiple use states which probably also can be used at the same time. Therefore, one set of composite furniture can meet varying use requirements. For instance, Germany patent No. DE2327906 discloses a chair with a chair backrest that can be flipped for ninety degrees about a pivotal point to become tabletop. But the height of the tabletop cannot be adjusted after the chair backrest is flipped. Moreover, the flipping of the chair backrest relies on a single pivotal point which is easily to be damaged due to uneven applying forces or easily loosens off after used for a long period of time to result in changing the use states of the chair difficult.

Furthermore, Taiwan utility model No. M436398 also discloses a composite chair that provides multiple use states. It includes a rack and at least one carrying portion and one movable portion installed on the rack. The movable portion includes a movable deck, two coupling members and an adjustment member. Each of the coupling members has a fastening end hinged on the rack and a movable end hinged on the movable deck. The movable end can be turned about the fastening end in a rotary displacement. The adjustment member has two guiding tracks extended along the movable deck, a linkage bar with two ends held in the two guiding tracks and two movable arms respectively connected to the linkage bar and movable deck. When the linkage bar moves in the guiding tracks, the coupling members are coupled with the movable arms during the rotary displacement to drive the movable deck to move upwards or downwards against the carrying portion so as to change the chair to become different use states.

However, the movable deck of the aforesaid composite chair is coupled with the chair backrest through the coupling members and the position of the movable deck is controlled by the two guiding tracks of the adjustment member and the linkage bar. Such a structure cannot fix and support the movable deck securely. Users could inadvertently touch the movable deck to cause the linkage bar to slide along the two guiding tracks to change the height of the movable deck.

SUMMARY OF THE INVENTION

The primary object of the present invention is to provide a composite chair with a firm structure.

To achieve the foregoing object, the composite chair according to the invention includes a stationary seat and a movable portion which is installed on the stationary seat. The stationary seat includes at least one first carrying portion for people seating and two first tracks. The movable portion includes a second carrying portion and a linkage mechanism connected to the stationary seat and second carrying portion to allow the second carrying portion to proceed a lift movement against the stationary seat. The second carrying portion includes two second tracks. The linkage mechanism includes two first linkage bars and two second linkage bars respectively hinged on the two first linkage bars. Each of the two first linkage bars has a first slide end slidable along the first track and a first pivotal end hinged on the second carrying portion. Each of the two second linkage bars has a second slide end coupled to and slidable along the second track and a second pivotal end hinged on the stationary seat.

In one aspect the composite chair includes a lifted state in which the first slide ends move along the first tracks towards the second pivotal ends, and the second slide ends move along the second tracks towards the first pivotal ends so that the second carrying portion is supported by the first linkage bars and second linkage bars and lifted. The composite chair also includes a descended state in which the first slide ends move away from the second pivotal ends along the first tracks and the second slide ends move away from the first pivotal ends along the second tracks so that the second carrying portion is descended at the same height of the first carrying portion.

In one embodiment the linkage mechanism includes a first connection bar to bridge the two first slide ends.

In another embodiment the linkage mechanism includes a second connection bar to bridge the two second slide ends.

In yet another embodiment the first track has a first notch at one side proximate the second pivotal end to hold the first slide end and confine movement of the first linkage bar.

In yet another embodiment the first track has a second notch at another side remote from the second pivotal end.

In yet another embodiment the linkage mechanism includes an anchor portion coupled to the first track, a drawing bar running through the anchor portion and a detent portion located above the first notch and connected to and drawn by the drawing bar to selectively confine the first slide end from escaping the first notch.

In yet another embodiment the linkage mechanism includes an elastic element held in the anchor portion and connected to and compressible by the detent portion when the drawing bar is drawn to generate a return force.

In yet another embodiment the stationary seat includes a support portion located between the first tracks and second carrying portion to support the second carrying portion.

The composite chair of the invention thus formed can provide many advantages, notably:

Through the two first linkage bars sliding along the two first tracks and the two second linkage bars sliding along the two second tracks, the second carrying portion can be lifted or descended, hence the composite chair can be switched between the lifted state and the descended state, i.e. the second carrying portion can be lifted against the first carrying portion to serve as a tabletop for holding goods. As a result, the second carrying portion can provide multiple functions for people seating or be transformed to become a tabletop.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT

Figure 1:
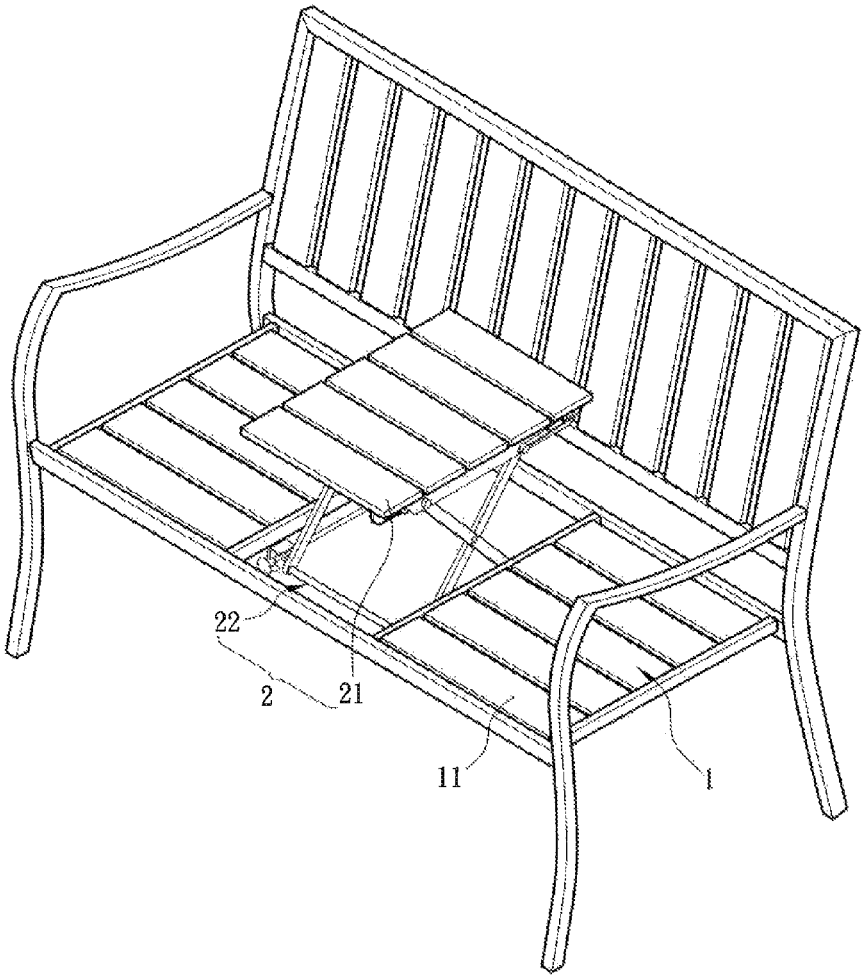
FIG. 1 is a perspective view of an embodiment of the invention.
Figure 2:
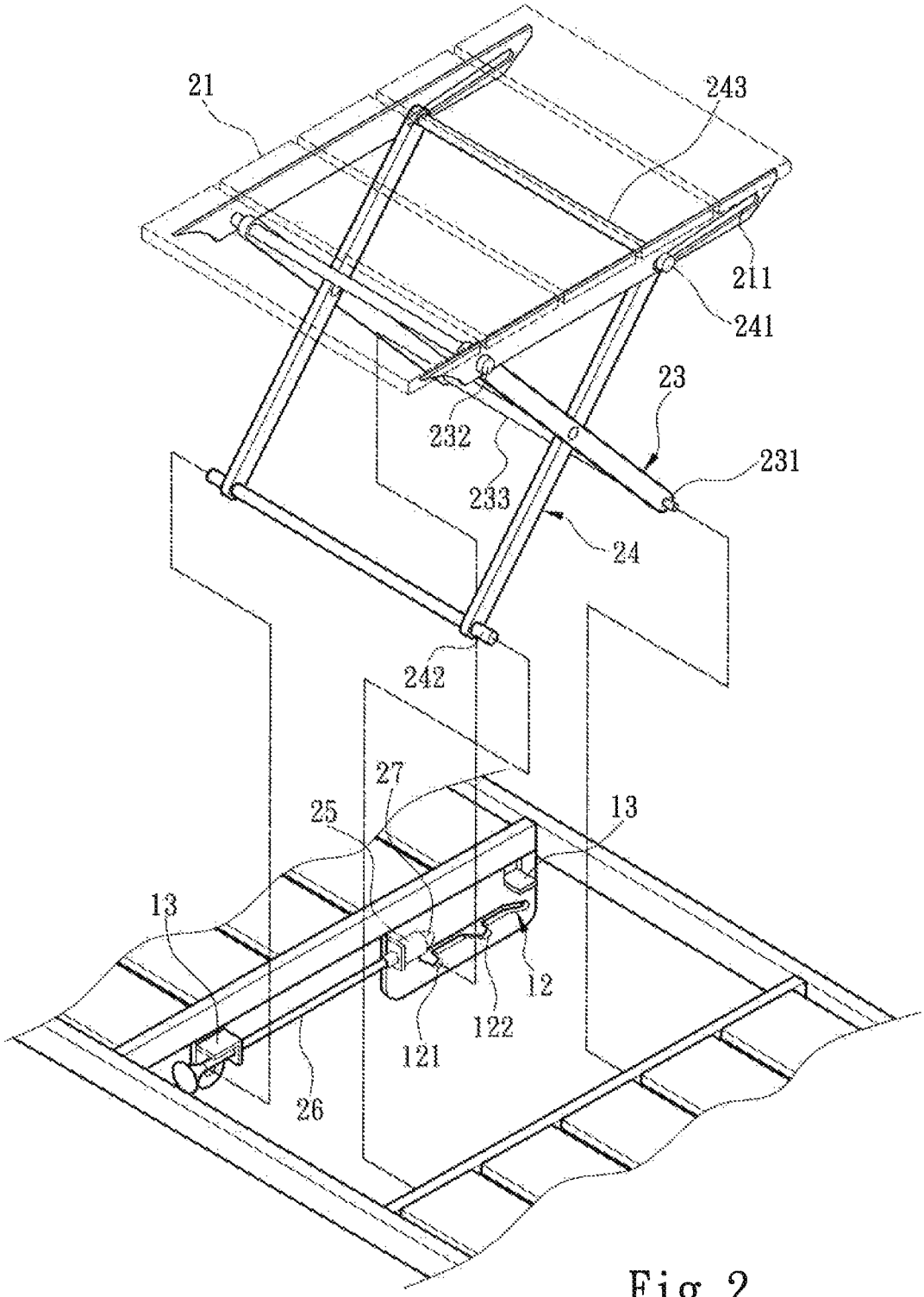
FIG. 2 is an exploded view of an embodiment of the invention.
Figure 3A:
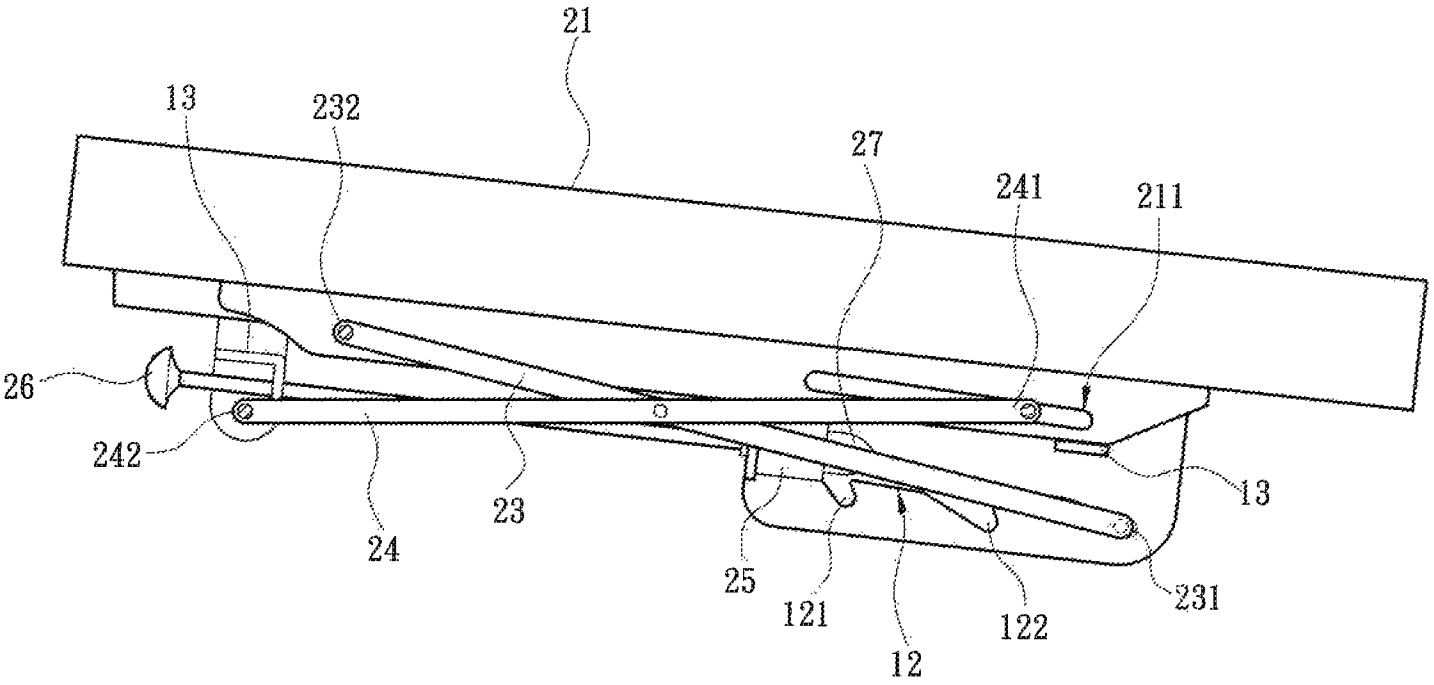
FIGS. 3A through 3D are schematic views of an embodiment of the invention in moving conditions.
Figure 3B:
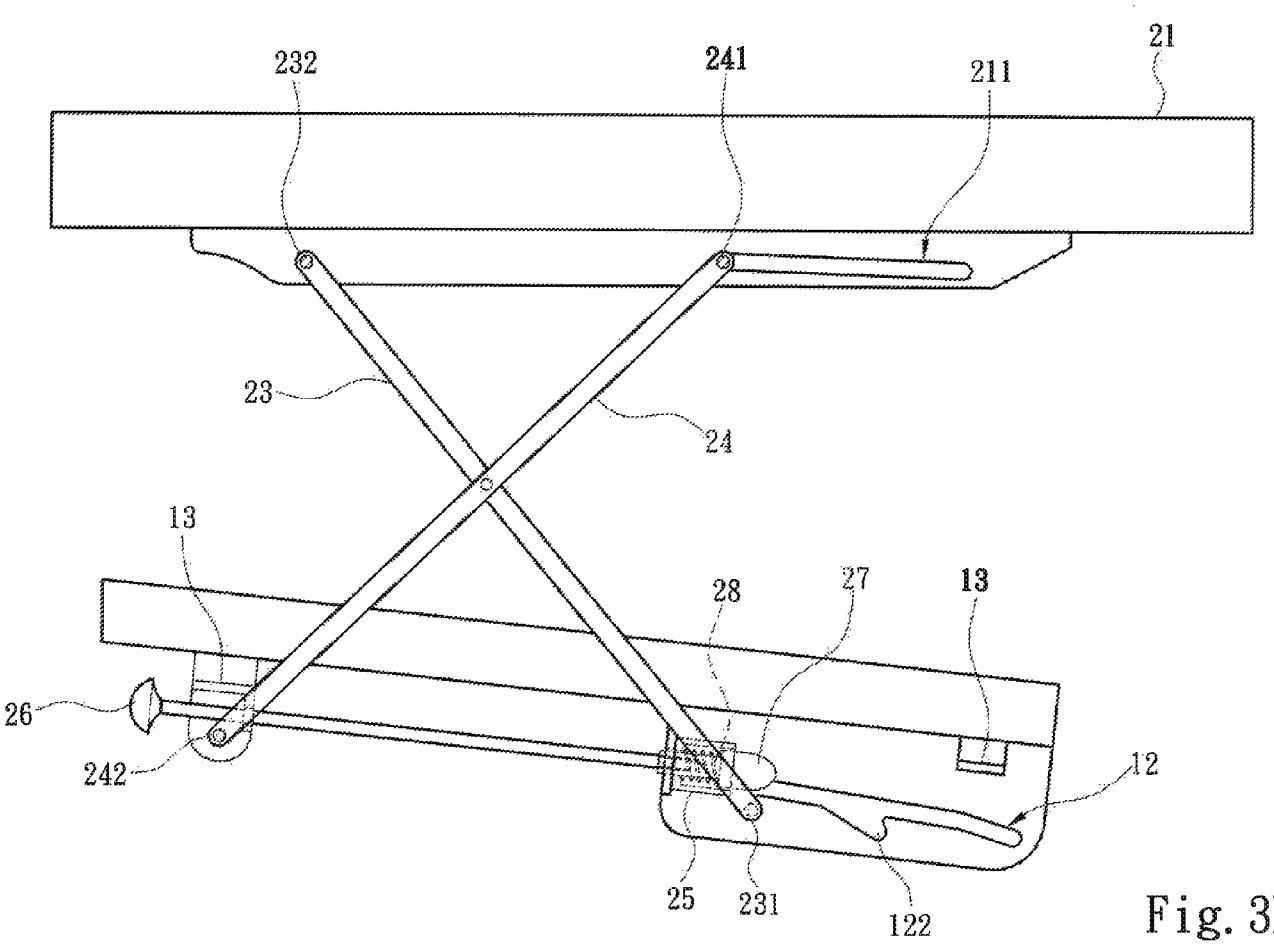
Figure 3C:
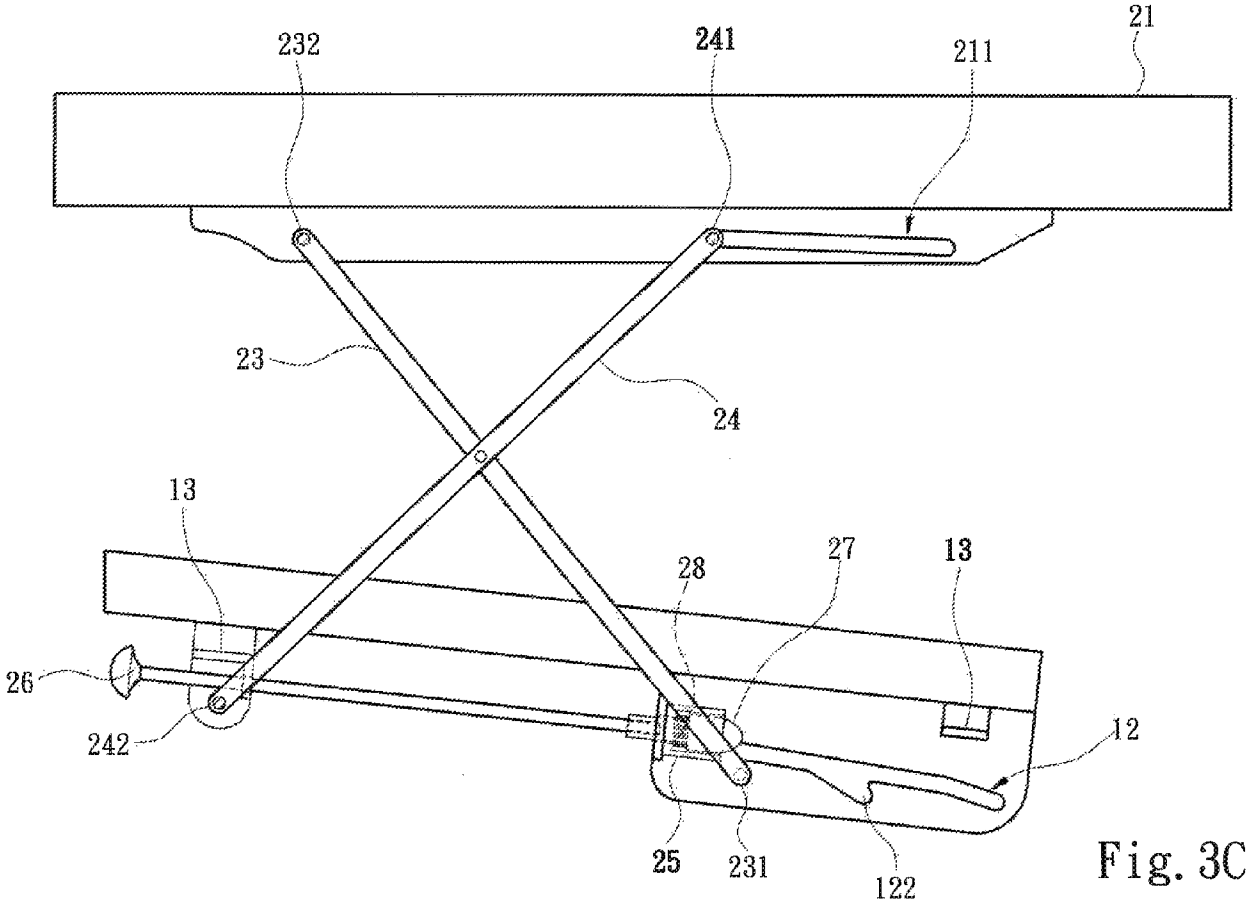
Figure 3D:
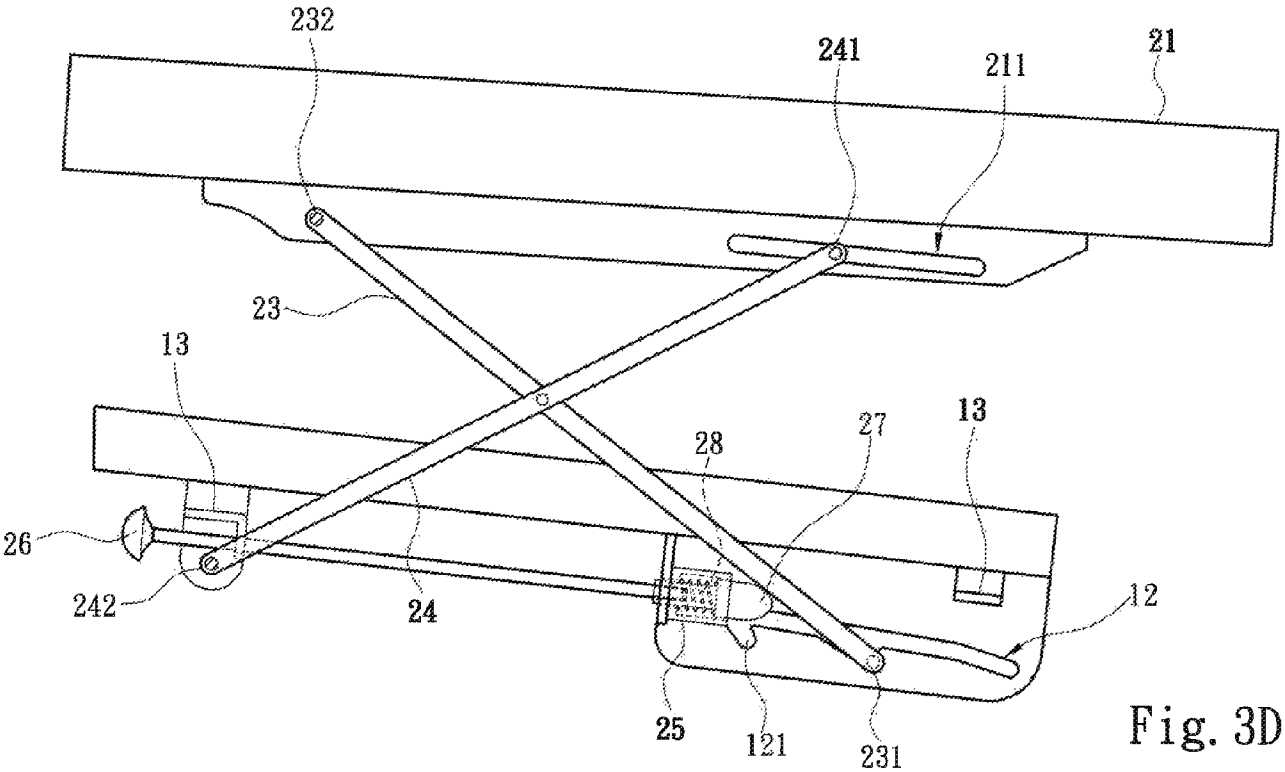

Please refer to FIGS. 1 and 2 for an embodiment of the composite chair of the invention. It includes a stationary seat 1 and a movable portion 2 installed on the stationary seat 1. The stationary seat 1 has at least one first carrying portion 11 for people seating and two first tracks 12. The movable portion 2 includes a second carrying portion 21 and a linkage mechanism 22 connected to the stationary seat 1 and the second carrying portion 21 to allow the second carrying portion 21 to proceed a lift movement against the stationary seat 1. The second carrying portion 21 includes two second tracks 211. The linkage mechanism 22 includes two first linkage bars 23 and two second linkage bars 24 respectively hinged on the two first linkage bars 23. Each of the two first linkage bars 23 includes a first slide end 231 slidable along the first track 12 and a first pivotal end 232 hinged on the second carrying portion 21. Each of the two second linkage bars 24 includes a second slide end 241 coupled to and slidable along the second track 211 and a second pivotal end 242 hinged on the stationary seat 1.

The first slide ends 231 are movable along the first tracks 12 towards the second pivotal ends 242, and the second slide ends 241 are movable along the second tracks 211 towards the first pivotal ends 232, thereby the second carrying portion 21 is supported by the first and second linkage bars 23 and 24 and raised to a lifted state. Alternatively, the first slide ends 231 also can slide along the first tracks 12 away from the second pivotal ends 242, and the second slide ends 241 can slide along the second tracks 211 away from the first pivotal ends 232 to descend the second carrying portion 21 at the same height of the first carrying portion 11 to a descended state.

Please refer to FIGS. 3A through 3D, the two first linkage bars 23, two second linkage bars 24, two first tracks 12 and two second tracks 211 are all symmetrical elements. To facilitate discussion, only one set of them is elaborated hereunder. To maintain the lifted height of the second carrying portion 21, the first track 12 has a first notch 121 at one side proximate the second pivotal end 242 to hold the first slide end 231. When the second carrying portion 21 is lifted upwards, the second slide end 241 of the second linkage bar 24 slides along the second track 211, and the first slide end 231 of the first linkage bar 23 slides along the first track 12 towards the second pivotal end 242 until arriving the first notch 121 which provides a support force for the first linkage bar 23 and confines the first slide end 231 from moving, thereby holds the second carrying portion 21 at a desired height.

Although the first notch 121 can confine the first slide end 231 from moving, the first slide end 231 still could escape the first notch 121 because of user's inadvertent touch to pull the first linkage bar 23, and could result in abrupt descent of the second carrying portion 21. To prevent such an incident from taking place, the linkage mechanism 22 further includes an anchor portion 25 coupled on the first track 12, a drawing bar 26 running through the anchor portion 25, a detent portion 27 located above the first notch 121 and connected to and drawable by the drawing bar 26, and an elastic element 28 held in the anchor portion 25 and connected to the detent portion 27. As the detent portion 27 is located above the first notch 121, it can confine the first slide end 231 from escaping the first notch 121 in normal conditions.

If it is desired to switch the composite chair to the lifted state with the second carrying portion 21 at an elevation higher than the first carrying portion 11 to become a tabletop, merely the second carrying portion 21 is needed to be lifted. Meanwhile, the first slide end 231 and second slide end 241 move respectively along the first track 12 and second track 211, and the second linkage bar 24 hinged on the first linkage bar 23 is driven to allow the second slide end 241 to move along the second track 211 towards the first pivotal end 232. When the first slide end 231 moves to a position above the first notch 121, it pushes the detent portion 27 away and drops into the first notch 121, thereby the composite chair is switched to the lifted state.

If it is desired to switch the composite chair to the descended state, the drawing bar 26 is drawn to drive the detent portion 27 to move away from the position above the first notch 121. Then, the second carrying portion 21 is raised so that the first slide end 231 can escape the first notch 121 and move away from the second pivotal end 242 along the first track 12, and the second slide end 241 of the second linkage bar 24 can move away from the first pivotal end 232 along the second track 211, therefore the second carrying portion 21 can be descended. The elastic element 28 held in the anchor portion 25 is compressed by the detent portion 27 while the drawing bar 26 is pulled to generate a return force. When the first slide end 231 escapes the first notch 121 along the first track 12, the drawing bar 26 can be released by the user to return to the position above the first notch 121 due to the return force. Moreover, to prevent the second carrying portion 21 from descending too quickly that might cause the accident of hurting user's hands, the first track 12 further includes a second notch 122 remote from the second pivotal end 242. When the first slide end 231 is moved away from the second pivotal end 242 along the first track 12, it drops into the second notch 122 and is confined without sliding. Aside from buffering the descending speed of the second carrying portion 21, the second notch 122 also provides a support force for the second carrying portion 21 when the first slide end 231 of the first linkage bar 23 drops into the second notch 122, thereby the second carrying portion 21 can be held at another height. As a result, the second carrying portion 21 can have the versatility of being held at two different elevations.

Finally, the stationary seat 1 further includes a support portion 13 located between the first track 12 and second carrying portion 21 to support the second carrying portion 21. When user desires to descend the second carrying portion 21 to the original position parallel with the first carrying portion 11 for people seating, only the second carrying portion 21 is needed to be raised to disengage the first slide end 121 from the second notch 122 and move away from the second pivotal end 242. Hence the second carrying portion 21 can be descended to the support portion 13 to return to the descended state.

Please refer to FIG. 2 again, in order to enhance coupling of the two first linkage bars 23 and two second linkage bars 24, the linkage mechanism 22 further includes a first connection bar 233 to bridge the two first slide ends 231 and a second connection bar 243 to bridge the two second slide ends 241, therefore the two first linkage bars 23 and two second linkage bars 24 can be moved synchronously to further increase the stability of the composite chair.

As a conclusion, in the invention, through the two first linkage bars 23 sliding along the two first tracks 12, and the two second linkage bars 24 sliding along the two second tracks 211, the second carrying portion 21 can be lifted or descended to allow the composite chair to switch between a lifted state and a descended state. In other words, the second carrying portion 21 can be raised against the first carrying portion 11 to become a tabletop for holding goods, thereby provide multiple functions of seating or switching to the tabletop. In addition, through the first notch 121 and second notch 122, the second carrying portion 21 can be held at two different heights. Moreover, the second notch 122 also provides a function of buffering the descending speed to prevent rapid dropping from hurting user's hands.

While the preferred embodiment of the invention has been set forth for the purpose of disclosure, it is not the limitation of the invention, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. A composite chair, comprising:

a stationary seat including at least one first carrying portion for people seating and two first tracks; and a movable portion which is installed on the stationary seat and includes a second carrying portion and a linkage mechanism connected to the stationary seat and the second carrying portion to allow the second carrying portion to proceed a lift movement upwardly away from the stationary seat; the second carrying portion including two second tracks, the linkage mechanism including two first linkage bars and two second linkage bars respectively hinged on the two first linkage bars, each of the two first linkage bars including a first slide end slidable along the first track and a first pivotal end hinged on the second carrying portion, each of the two second linkage bars including a second slide end coupled to and slidable along the second track and a second pivotal end hinged on the stationary seat;

wherein the composite chair includes a lifted state in which the first slide ends move along the first tracks toward the second pivotal ends and the second slide ends move along the second tracks toward the first pivotal ends such that the second carrying portion is supported and lifted by the first linkage bars and the second linkage bars, and a descended state in which the first slide ends move away from the second pivotal ends along the first tracks and the second slide ends move away from the first pivotal ends along the second tracks such that the second carrying portion is descended at a same height of the first carrying portion;

wherein the first track includes a first notch at one side proximate the second pivotal end to hold the first slide end and confine movement of the first linkage bar, and wherein the linkage mechanism includes an anchor portion coupled on the first track, a drawing bar running through the anchor portion along a direction and a detent portion located above the first notch and connected to and drawable by the drawing bar to selectively cover the first notch so as to selectively confine the first slide end from escaping the first notch.

2. The composite chair of claim 1, wherein the linkage mechanism includes a first connecting bar to bridge the two first slide ends.

3. The composite chair of claim 1, wherein the linkage mechanism includes a second connecting bar to bridge the two second slide ends.

4. The composite chair of claim 1, wherein the first track includes a second notch at another side remote from the second pivotal end.

5. The composite chair of claim 1, wherein the linkage mechanism includes an elastic element held in the anchor portion and connected to and compressible by the detent portion to generate a return force when the drawing bar is drawn.

6. The composite chair of claim 1, wherein the stationary seat includes a support portion located between the first track and the second carrying portion to support the second carrying portion.

* * * * *